US008454380B2

(12) United States Patent
Zhu et al.

(10) Patent No.: US 8,454,380 B2
(45) Date of Patent: Jun. 4, 2013

(54) CARD EDGE CONNECTOR

(75) Inventors: Jian-Kuang Zhu, Kunshan (CN); Da-Lei Chen, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 164 days.

(21) Appl. No.: 13/007,994

(22) Filed: Jan. 17, 2011

(65) Prior Publication Data

US 2011/0287664 A1 Nov. 24, 2011

(51) Int. Cl.
*H01R 13/62* (2006.01)

(52) U.S. Cl.
USPC ..... 439/326

(58) Field of Classification Search
USPC ..... 439/326–328
See application file for complete search history.

(56) References Cited

U.S. PATENT DOCUMENTS 5,997,332 A * 12/1999 Choy ..... 439/328
6,027,357 A * 2/2000 Howell et al. ..... 439/326
6,276,951 B1 * 8/2001 Chen et al. ..... 439/327
6,419,513 B1 * 7/2002 Choy ..... 439/326
6,540,550 B2 * 4/2003 Chang et al. ..... 439/541.5
6,663,407 B1 * 12/2003 Pickles ..... 439/328
6,666,702 B1 * 12/2003 Pickles ..... 439/326
6,726,499 B1 4/2004 Yu
6,948,964 B2 * 9/2005 Lee ..... 439/328
7,048,565 B2 * 5/2006 Lin ..... 439/326
7,494,361 B2 * 2/2009 Ho ..... 439/326

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

A card edge connector includes an elongated housing having an upper wall and a lower wall defining a mating cavity therebetween and extending along a longitudinal direction. A plurality of terminal grooves are respectively defined in the upper wall and lower wall and in communication with the mating cavity. A plurality of contacts are respectively received in said terminal grooves. A pair of locking devices are disposed at opposite ends of the mating cavity and extend along a rear-to-front direction perpendicular to the longitudinal direction. A recess facing the upper wall is defined in the lower wall and extends along the longitudinal direction under condition that two longitudinal ends of the recess are closer to the upper wall than a middle portion of the recess.

10 Claims, 6 Drawing Sheets

CARD EDGE CONNECTOR

BACKGROUND OF THE INVENTION

1. Field of the Invention

The present invention relates to a card edge connector, and in particular to a card edge connector connecting an electronic card to a printed circuit board.

2. Description of the Related Art

U.S. Pat. No. 6,726,499 issued to Yu on Apr. 27, 2004 discloses a card edge connector connecting an electronic card to a printed circuit board. The card edge connector comprises an insulative housing and a row of upper terminals and a row of lower terminals retained therein. The insulative housing has an upper sidewall, a lower sidewall, a rear sidewall, and a pair of spring arms extending frontwardly from two distal ends thereof. The rear sidewall connects with the upper sidewall and the lower sidewall thereby defining a central slot therebetween. The upper sidewall has a slant upper guiding face, and the lower sidewall has a slant lower guiding face which is parallel with the upper guiding face. Each terminal has a mating portion and a mounting portion, the mating portion extending into the slot while the mounting portion extending out of the insulative housing for mounting onto the motherboard. The mating portions of the lower terminals are located in front of the mating portions of the upper terminals. When a front edge of the electronic card inserts into the central slot at an angle with regard to the lower sidewall, the front edge of the electronic card engages with the lower sidewall, then the electronic card is pressed downwardly with its front edge raised, in this state, the front edge of the electronic card will scrape with the lower sidewall and produce some plastic pieces, which may weak the electrical connection between the mating portions of the terminals and the electronic card. Obviously, an improved card edge connector is highly desired to overcome the aforementioned problem.

SUMMARY OF THE INVENTION

Accordingly, an object of the present invention is to provide a card edge connector which can prevent the electronic card scraping with a lower side wall of the card edge connector.

In order to achieve the object set forth, a card edge connector includes an elongated housing having an upper wall and a lower wall defining a mating cavity therebetween and extending along a longitudinal direction. A plurality of terminal grooves are respectively defined in the upper wall and lower wall and in communication with the mating cavity. A plurality of contacts are respectively received in said terminal grooves. A pair of locking devices are disposed at opposite ends of the mating cavity and extend along a rear-to-front direction perpendicular to the longitudinal direction. A recess facing the upper wall is defined in the lower wall and extends along the longitudinal direction under condition that two longitudinal ends of the recess are closer to the upper wall than a middle portion of the recess.

Other objects, advantages and novel features of the invention will become more apparent from the following detailed description of the present embodiment when taken in conjunction with the accompanying drawings.

DETAILED DESCRIPTION OF THE INVENTION

Figure 1:
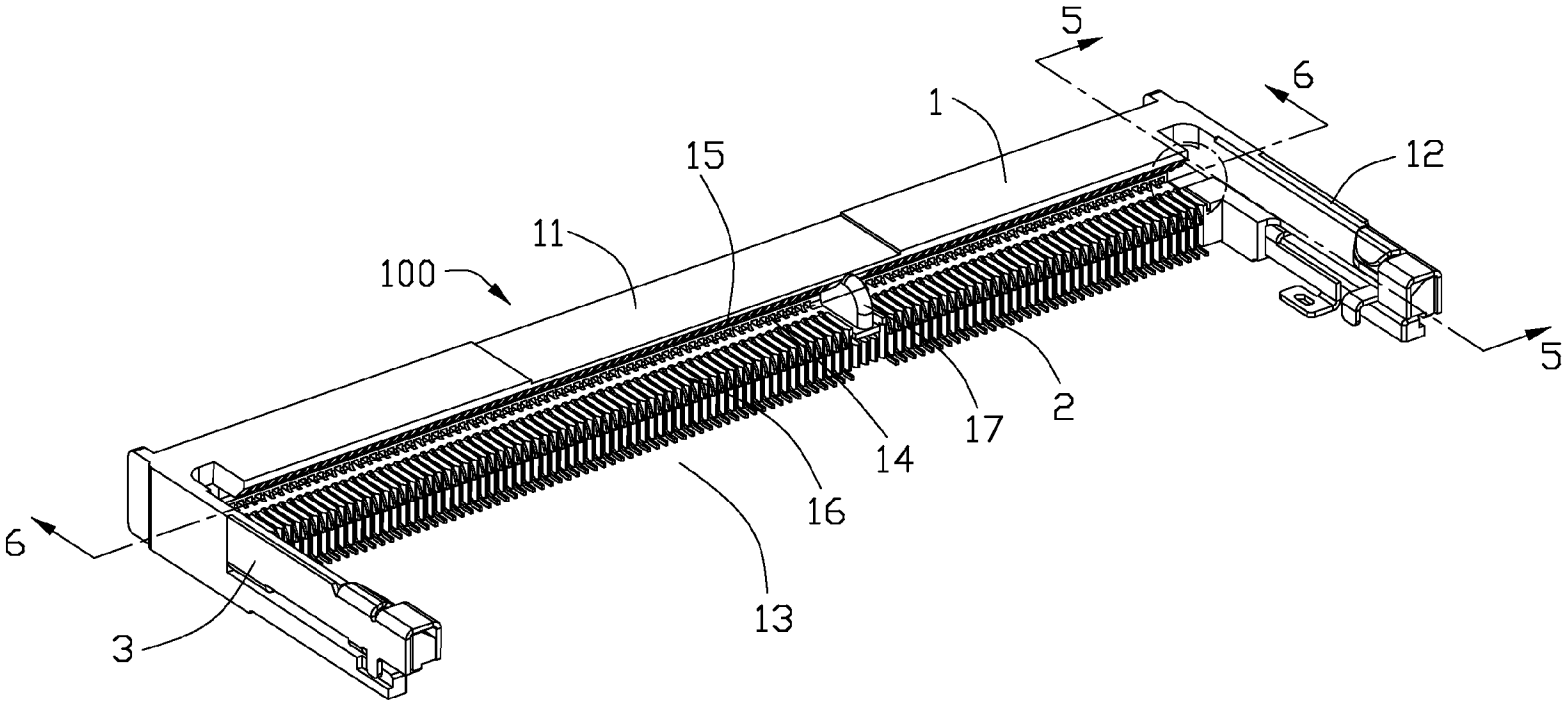
FIG. 1 is a perspective view of a card edge connector in accordance with the present invention.
Figure 2:
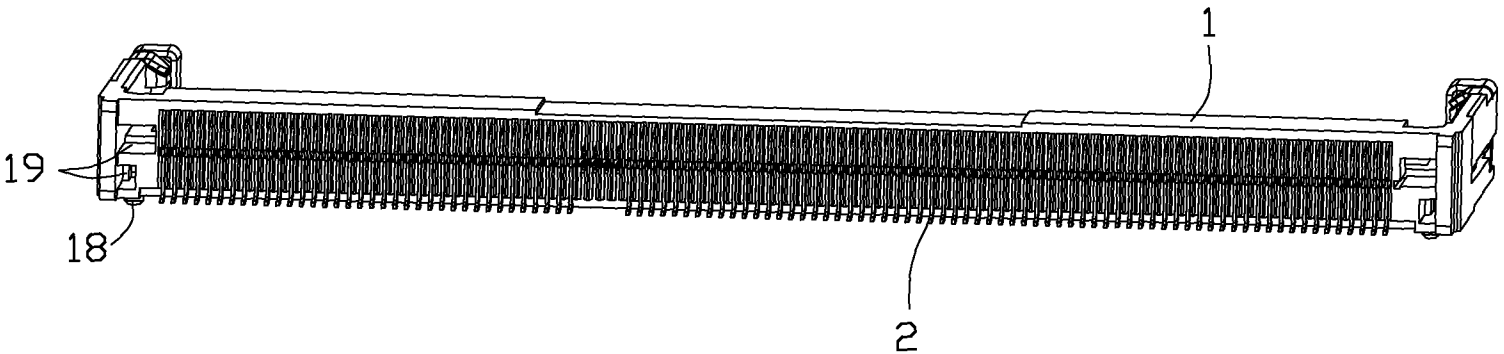
FIG. 2 is another perspective view of the card edge connector shown in FIG. 1.

Reference will now be made to the drawing figures to describe a preferred embodiment of the present invention in detail. Referring to FIG. 1 to FIG. 2, a card edge connector 100 according to the preferred embodiment of the present invention is provided for connecting an electronic card to a printed circuit board (PCB). The card edge connector 100 comprises an insulative housing 1 with a plurality of conductive terminals 2 received therein and a pair of locking devices 3 at opposite ends of the insulative housing 1.

The insulative housing 1 comprises an elongated base portion 11 and a pair of arms 12 disposed at opposite longitudinal ends of the base portion 11 and extending along a rear-to-front direction thereby defining a receiving space 13 therebetween for receiving the electronic card. A mating groove 14 is defined along a longitudinal direction of the base portion 11 and faced to the receiving space 13 for receiving a front edge of the electronic card. An upper wall 15 and a lower wall 16 are respectively formed at opposite sides of the mating groove 14, on which a plurality of terminal grooves 151,161 are respectively defined for receiving said conductive terminals 2. Further, the lower wall 16 exceeds the upper wall 15 in the front-to-rear direction, therefore the electronic card inserts into the mating groove 14 at an angle relative to the card edge connector. A key 17 for cooperating with a notch defined at the front edge of the electronic card is formed in the mating groove 14 adjacent to one of the arms 12 so as to realize an anti-mismating function. Additionally, a pair of posts 18 at formed at a bottom face of the base portion 11 for positioning the card edge connector 100 on the PCB. Further referring to FIGS. 5 and 6, the lower wall 16 forms a supporting surface 162 parallel to the PCB when the card edge connector 100 is mounted thereon, and the upper wall 15 also forms an inner surface 152 opposed to the supporting surface 162 and parallel to the supporting surface 162. A gap 191 is defined on the upper wall 15 closer to the arm 11 for receiving the post 18 during the transportation of the card edge connectors 100.

Figure 3:
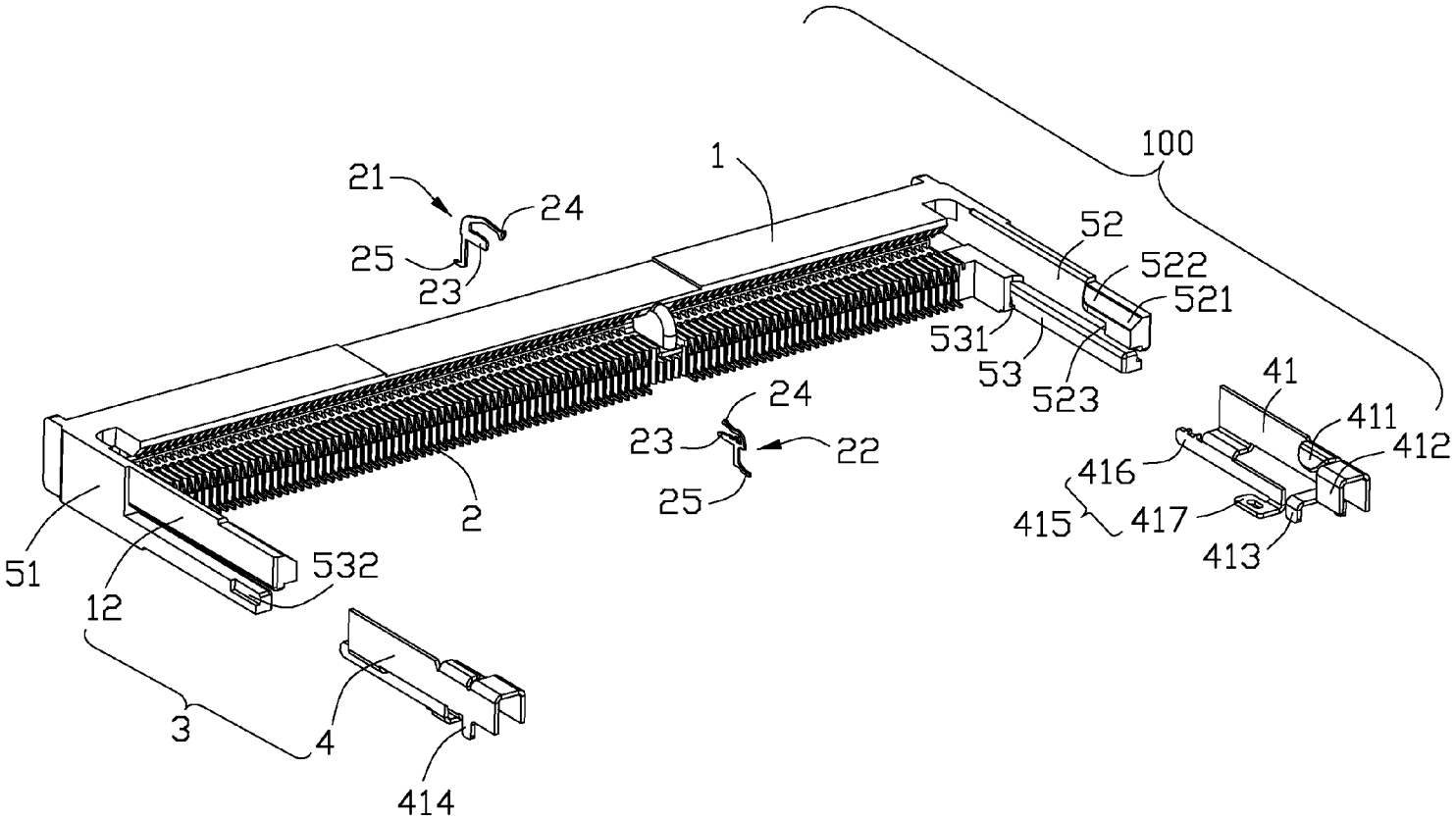
FIG. 3 is an exploded perspective view of the card edge connector shown in FIG. 1.

Referring to FIGS. 1 and 3, each locking device 3 comprises the arm 12 made from plastic material and a retaining plate 4 made from metallic material. The arm 12 comprises a root portion 51 unitarily extending from the base portion 11, a locking arm 52 and a stopping arm 53 separately extending forward from the root portion 51. The locking arm 52 is located above the stopping arm 53 and in alignment with each other in a vertical direction perpendicularly to the rear-to-front direction. The locking arm 52 forms a protrusion portion 521 at a front inner side thereof and protruding toward the receiving space 13, and a locking portion 522 behind the protrusion portion 521. The locking portion 522 is cut partly at a bottom face thereof adjacent to the protrusion portion 521 thereby forming a stopping face 523 facing to the base portion 11. The stopping arm 53 defines a receiving passageway 531 adjacent to the root portion 51 and extending rearwardly. Additionally, a recess 532 is defined at a front lateral side of each stopping arm 53. The metallic retaining plate 4 has a main body 41 tightly attached to the lateral side of the locking arm 52, a hook 412 and a guiding plate 411 successively extending downwardly from an upper edge of the main body 41 for respectively covering on the protrusion portion 521 and the locking portion 522, and a supporting plate 413 and a retaining section 415 respectively extending laterally from a lower edge of the main body 41. The retaining section 415 comprises a retaining portion 416 extending rearward and fixed in the receiving passageway 531 for securing the retaining plate 4 on the arm 12, and a solder portion 417 extending laterally for soldering onto the PCB. In addition, a blocking plate 414 extends downwardly from the lower edge of the main body 41 toward the recess 532 for preventing the locking arm 52 moving inwardly overly.

Referring to FIG. 3, the conductive terminals 2 are divided into a row of upper terminals 21 and a row of lower terminals 22 and respectively received in the upper wall 15 and lower wall 16 for electrically contacting with the electronic card. The upper terminals 21 are inserted into the terminal grooves 151 from a rear side of the insulative housing 1, while the lower terminals 22 are inserted into the terminal grooves 161 from a front side of the insulative housing 1. The upper terminals 21 and the lower terminals 22 respectively comprise a retaining portion 23 secured in the related terminal grooves 151,161, a resilient contact portion 24 projecting into the mating groove 14, and a solder portion extending out of the insulative housing 1 for soldering onto the PCB.

Figure 4:
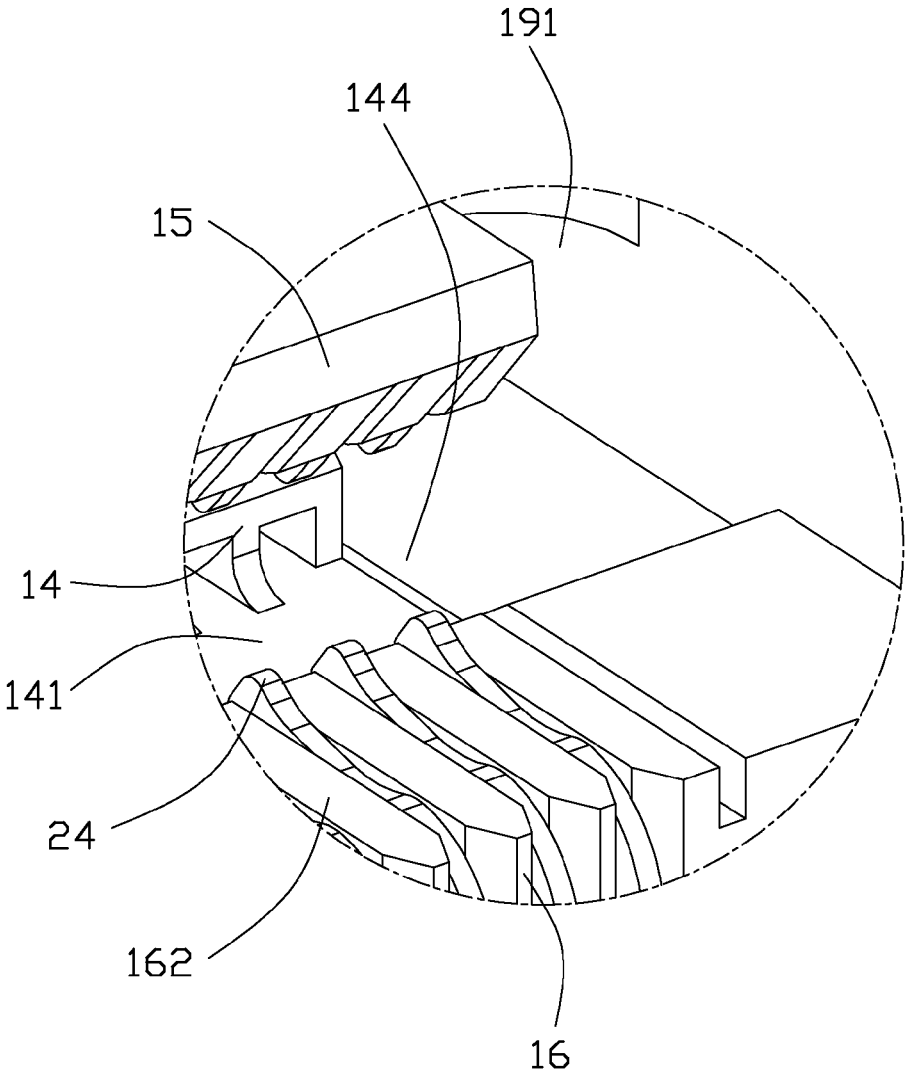
FIG. 4 is a partly amplified view of the card edge connector shown in FIG. 1.
Figure 5:
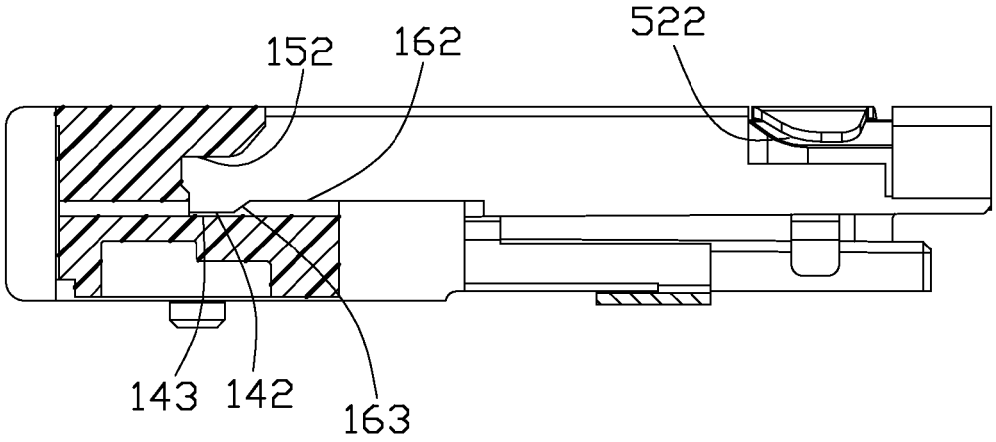
FIG. 5 is a cross-sectional view of the card edge connector shown in FIG. 1 along line 5-5.
Figure 6:
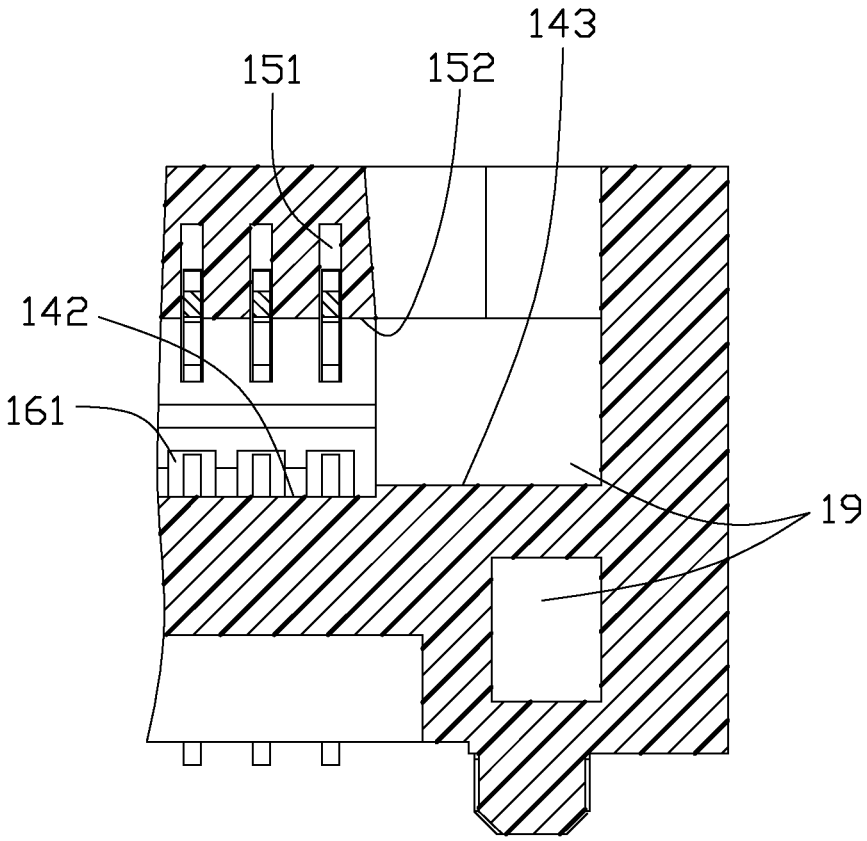
FIG. 6 is a cross-sectional view of the card edge connector shown in FIG. 1 along line 6-6.

Referring to FIGS. 4-6, the lower wall 16 defines an elongated recess cavity 141 recessed downwardly from the supporting surface 162 thereof. The recess cavity 141 is in a step shaped configuration and comprises a pair of first bottom sections 142 adjacent to the locking devices 3 and a second bottom section 143 located between the first bottom sections 142. The second bottom section 143 is among the terminal grooves 151,161, while the first bottom sections 142 are between the upper and lower walls 15, 16 without terminal grooves therein. Both of the first and second bottom sections 142, 143 are parallel to the supporting surface 162. Seen from a front view and along the front-to-rear direction, a step 163 is formed between the first bottom section 142 and the supporting surface 162, and another even sharper step is also formed between the second bottom section 143 and the supporting surface 162. In addition, the second bottom section 143 is lower than the first bottom sections 142 in the longitudinal direction, and each second bottom section 143 defines an engaging surface 144 at an upper side thereof.

When the electronic card is inserted into the mating cavity 14 at an angle, a front end of the electronic card projects into the recess cavity 141 and engages with the engaging surface 144 of the second bottom section 143, then the electronic card rotates downwardly until reaching to a horizontal position parallel to the supporting surface 162. The protrusion portions 521 are received in apertures defined at opposite lateral sides of the electronic card, and the locking portions 522 are pressed against an upper surface of the electronic card. During the rotation process, the front end of the electronic card just engages with the second bottom sections 143 and will not contact with the elongated first bottom section 142, therefore the electronic card would not scrap the region where the conductive terminals 2 are located, and scraps from the insulative housing will be reduced, which can ensure a perfect electrical connection between the card edge connector and the electronic card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting an electrical card to a printed circuit board comprising:

an elongated housing having an upper wall and a lower wall defining a mating groove therebetween and extending along a longitudinal direction for an insertion of said electrical card, a plurality of terminal grooves respectively defined in the upper wall and lower wall and in communication with the mating groove;

a plurality of contacts, respectively received in said terminal grooves; and a pair of locking devices disposed at opposite longitudinal ends of the mating groove and extending along a rear-to-front direction perpendicular to the longitudinal direction;

wherein the mating groove is defined with an upper horizontal surface on the top wall, a lower horizontal surface on a front end of the lower wall, and a lower inclined surface on the lower wall and in the back of the lower horizontal surface under a condition that the card are guided into the mating groove along the lower inclined surface and supported by the upper horizontal surface and lower horizontal surface when the card is rotated downwards to electrically connect with the contacts;

wherein the mating groove further is defined with an inner horizontal bottom surface in the back of the lower inclined surface, the inner horizontal bottom surface is construed with two first bottom surfaces and a second bottom surface between the two first bottom surface along the longitudinal direction, the first bottom surfaces are higher than the second bottom surface.

2. The card edge connector as described in claim 1, wherein the second bottom surface of the inner horizontal bottom surface is among the terminal grooves while the first bottom surfaces of the inner horizontal bottom surface is between the upper and lower walls without terminal grooves.

3. The card edge connector as described in claim 2, wherein the longitudinal ends of the recess are closer to the locking devices.

4. The card edge connector as described in claim 2, wherein the upper wall defines a pair of gaps extending rearwardly to expose the first bottom surface in an upper to lower direction.

5. The card edge connector as described in claim 1, wherein each locking device comprises a plastic arm extending forward from the elongated housing and a metallic retaining plate attached to the plastic arm not only strengthening the rigidity of the plastic arm but also soldering the card edge connector onto said printed circuit board.

6. The card edge connector as described in claim 5, wherein each plastic arm comprises an upper arm and a lower arm in alignment with each other, and the lower arm defines an aperture at a front lateral end thereof for receiving a blocking plate straightly extending downward from the metallic retaining plate.

7. A card edge connector assembly for use with a card adapted to be slantingly inserted into the mating groove, comprising:

an insulative housing having a horizontal elongated base extending along a lengthwise direction with an elongated mating groove extending therein along the lengthwise direction forwardly and upwardly communicating with an exterior to divide said housing into upper and lower walls in a vertical direction perpendicular to said lengthwise direction;

a plurality of upper contacts disposed in the housing with upper contacting sections located in the upper wall and extending into the mating groove;

a plurality of lower contacts disposed in the housing with lower contacting sections located in the lower wall and extending into the mating groove, the upper contacts being located behind the lower contacts in a front-to-back direction perpendicular to both said lengthwise direction and said vertical direction;

the lower wall defining an upper upward supporting surface configured to intimately upwardly confront the card when said card is located in a horizontal locked position with regard to the housing, and a lower upward supporting surface essentially located behind the lower contacts and configured to be downwardly abutted against by a front edge of the card when said card is inserted into the mating groove in a slanted unlocked position;

said lower upward supporting surface including a first zone occupying most space of said mating groove to which said upper contacting sections and said lower contacting sections correspond in said front-to-back direction, and a pair of second zones respectively located at two opposite ends of said first zone in the lengthwise direction without involvement with any of the upper contacting sections and the lower contacting sections in any of said lengthwise direction, said vertical direction and said front-to-back direction; wherein the second zones are higher than the first zone for being abutted against by the bottom edge of the inserted card instead of the first zone.

8. The card edge connector as claimed in claim 7, wherein the upper upward supporting surface extends completely in a flat manner along said lengthwise direction.

9. The card edge connector as claimed in claim 7, further comprising a pair of locking devices extending forwardly from two opposite ends of the base, each of said locking devices including a protrusion portion at a free end for locking into a notch in a side edge of the card, and a locking portion joined with a rear face of the protrusion portion with a cutout in an under side for abutting against an upper surface of the inserted card.

10. The card edge connector as claimed in claim 7, wherein said upper upward supporting surface is essentially aligned with the lower contacts in the lengthwise direction.

* * * * *